US006311347B1

(12) United States Patent
Limardi et al.

(10) Patent No.: US 6,311,347 B1
(45) Date of Patent: Nov. 6, 2001

(54) SECTIONAL BED COVERING

(76) Inventors: Virginia Ann Limardi; Henry Limardi, both of 540 Palmetto Rd., Belleair, FL (US) 33756

( * ) Notice: Subject to any disclaimer, the term of this patent is extended or adjusted under 35 U.S.C. 154(b) by 0 days.

(21) Appl. No.: 09/560,966

(22) Filed: Apr. 28, 2000

Related U.S. Application Data

(60) Provisional application No. 60/134,626, filed on May 18, 1999.

(51) Int. Cl.[7] ..... A47G 9/04
(52) U.S. Cl. ..... 5/486; 5/482; 5/502
(58) Field of Search ..... 5/482, 486, 496, 5/502, 923

(56) References Cited

U.S. PATENT DOCUMENTS

| | | | | |
|---|---|---|---|---|
| 1,267,042 | * | 5/1918 | Arnold | 5/486 |
| 2,689,961 | * | 9/1954 | Lieberthal | 5/486 |
| 2,730,728 | * | 1/1956 | Roberts | 5/486 |
| 3,072,776 | * | 1/1963 | Quenneville | 5/486 X |
| 3,331,088 | * | 7/1967 | Marquette | 5/502 |
| 3,508,285 | * | 4/1970 | Marquette | 5/486 |
| 3,530,516 | * | 9/1970 | Marquette | 5/486 |
| 4,005,499 | * | 2/1977 | Klein | 5/486 X |
| 4,069,526 | * | 1/1978 | Deikel | 5/486 |
| 4,573,227 | * | 3/1986 | Prandina | 5/486 |
| 4,802,251 | * | 2/1989 | O'Dell | 5/502 |
| 5,287,573 | * | 2/1994 | Ritacco | 5/486 |
| 5,943,717 | * | 8/1999 | Alexander | 5/486 |
| 6,226,814 | * | 5/2001 | Alexander | 5/486 |

FOREIGN PATENT DOCUMENTS

| | | | | |
|---|---|---|---|---|
| 2569096 | * | 2/1986 | (FR) | 5/486 |

* cited by examiner

*Primary Examiner*—Robert G. Santos

(57) ABSTRACT

A sectional bed covering such as a blanket or comforter provided with two upper longitudinal sections that overlap each other and are permanently attached to a transverse base section, the upper sections can be fastened together by use of one or more buttons, or other suitable fasteners to provide a single unit bed covering for convenience when making or unmaking the bed or if a single unit cover is preferred for personal comfort, when left unattached the two upper sections can provide the versatility of two independent covers for personal comfort while still providing the convenience of a single unit cover.

3 Claims, 2 Drawing Sheets

SECTIONAL BED COVERING

CROSS-REFERENCE TO RELATED APPLICATIONS

Provisional application—application #60/134,626 filing date May 18, 1999

BACKGROUND—Field of the Invention

This invention relates to bed covering, specifically to improve their versatility by providing two upper sections that can easily be separated or attached for independent use.

BACKGROUND—Description of Prior Art

Bed covers, such as blankets, provide warmth and comfort for individuals in bed. They do not, however, take into consideration the different comfort requirements of two people occupying the same bed. Heretofore, several types of bed covering assemblies to address individual comfort requirements have been invented. U.S. Pat. No. 4,573,227 to Prandina (1986) two single blankets provided with buttons and related buttonholes so that the two sections can be joined together. This design is not only cumbersome and time consuming to attach and detach the two halves but there is no overlapping of the two halves to provide enough cover for a person when the other person is not using their blanket.

U.S. Pat. No. 4,069,526 to Deikel (1978) shows a complex design of blanket members, the approximate size equal to the bed, also first and second coverlet members. This design would be expensive to manufacture, due to the amount of fabric involved, the time involved to make the various parts. There is no overlap between the sections for adequate personal coverage U.S. Pat. No. 4,005,499 to Klein (1977) shows two separate blanket halves that can be attached by several ribbons. Each half is provided with a pocket for carrying a treated pad. This design is not practical because of the large hem and pockets at the head of the blanket would prove to annoying to most people. The tying and untying of the ribbons to attach or detach the two sections is also a disadvantage.

U.S. Pat. No. 3,508,285 to Marquette (1970) shows several panels, with different warmth characteristics that can be joined edge to edge. This design would be difficult to work with. The people using the blanket would have to pre-determine if they were going to be hot or cold that evening or make the difficult change of panels during the night. There is also a lack of overlap between the panels to allow for personal coverage if the adjoining panel is not in use.

U.S. Pat. No. 2,689,961 to Lieberthal (1952) shows one panel of fabric split longitudinally to a point on the blanket. A zipper is provided to attach or detach the split section of the blanket. At the top of the blanket there is a protective flap. There are several design flaws in this concept. The zipper will have a tendency to get caught in the fabric, it will not hold up well under laundering, it is unpleasant to the touch and tends to go out of line and jam. The protective, zipper, flap at the head of the blanket, close to the users face will prove to annoying. There is no overlap between the split sections to provide ample coverage for either person when one section is not in use.

U.S. Pat. No. 2,730,728 to Roberts (1958) shows a single piece of fabric that is slit longitudinally to a point in the fabric. The slit is made off center so as to provide one wide panel and one narrow panel. The idea behind this design is that the person requiring more warmth will use the side with the wide panel while the other person, requiring less warmth will use the narrow panel. The design flaw here is that whenever two people share a bed, each person will usually occupy a particular side of the bed. This design assumes that the person requiring more coverage at one time will always require more coverage, or will have anticipate in advance if he or she will require more or less coverage so as to change what side of the bed they will occupy. Another design flaw is the lack of overlap between the slits to provide ample coverage for the person using the narrow panel when the wide panel is not in use. Both the design flaws stated make this concept non-user friendly.

U.S. Pat. No. 1,267,042 to Arnold (1918) shows two separate panels of fabric that can be interlocked by a series of folds or detached, for the purpose of easy handling, by undoing the interlocking folds. The design flaw here is that the attaching or detaching of the panels, for the purpose of personal coverage, would be time consuming and difficult, certainly, not something a person would want to deal with in the middle of the night. I also feel when the panels are interlocked a section of the blanket will have several layers of fabric which will be bulky and uncomfortable.

SUMMARY

It is the object of the invention to provide a sectional bed covering, as in a blanket or comforter, that will accommodate with ease individual comfort requirements when two persons share one bed, and yet parallel state of the art blankets or comforters in use and looks.

OBJECTS AND ADVANTAGES

Accordingly, several objects and advantages of my invention are . . . . The bed covering, either blanket or comforter is designed so that the two upper sections amply overlap each other at he center, to provide adequate coverage for either person when only one section is being used as a cover.

The two upper sections can be attached or detached quickly, with ease and convenience. The blanket or comforter will conform, with minor differences, in appearance and use to conventional blankets or comforters. This plus the other advantages stated will make this product very user friendly and marketable.

BRIEF DESCRIPTION OF THE DRAWINGS

Reference Numerals in Drawing

1 fastening devise (buttons)
2 two longitudinal sections
3 seam
4 base section
5 button holes
6 inner edge of right longitudinal section
7 inner edge of left longitudinal section

DESCRIPTION OF THE PREFERRED EMBODIMENT

Figure 1:
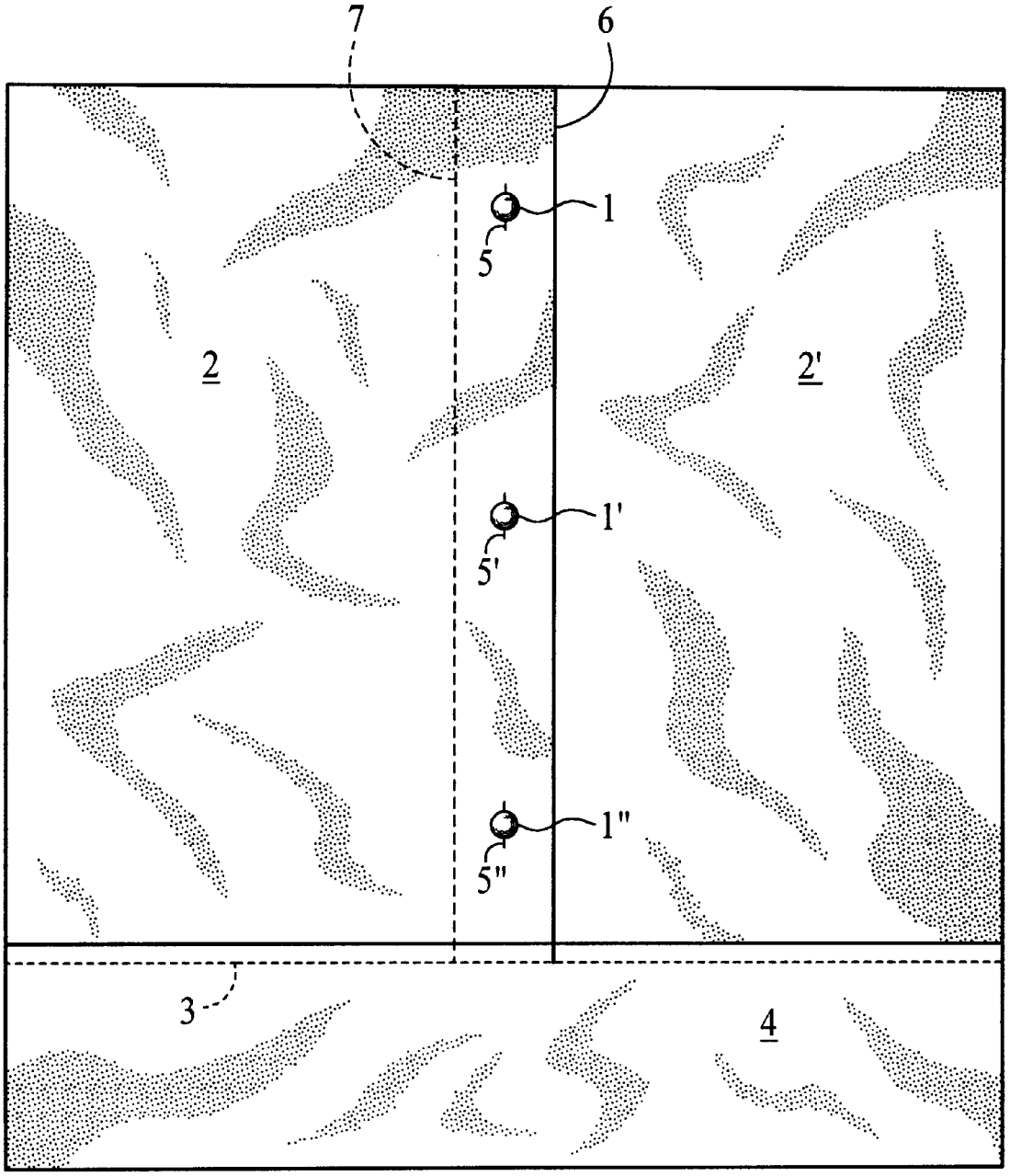
FIG. 1 is preferred embodiment of the present invention which shows the blanket laying flat with the two longitudinal sections overlapping each other and fastened together.

A preferred embodiment of the invention is illustrated in FIG. 1 showing the blanket laying flat, consisting of two longitudinal sections 2 & 2' that are permanently attached at the base 3 to a transverse section 4 that runs the width of the cover. The two longitudinal sections 2 & 2' are overlapping each other to provide ample width to each section. The two longitudinal sections 2 & 2' are fastened together, in this case, with buttons 1, 1' & 1".

Figure 2:
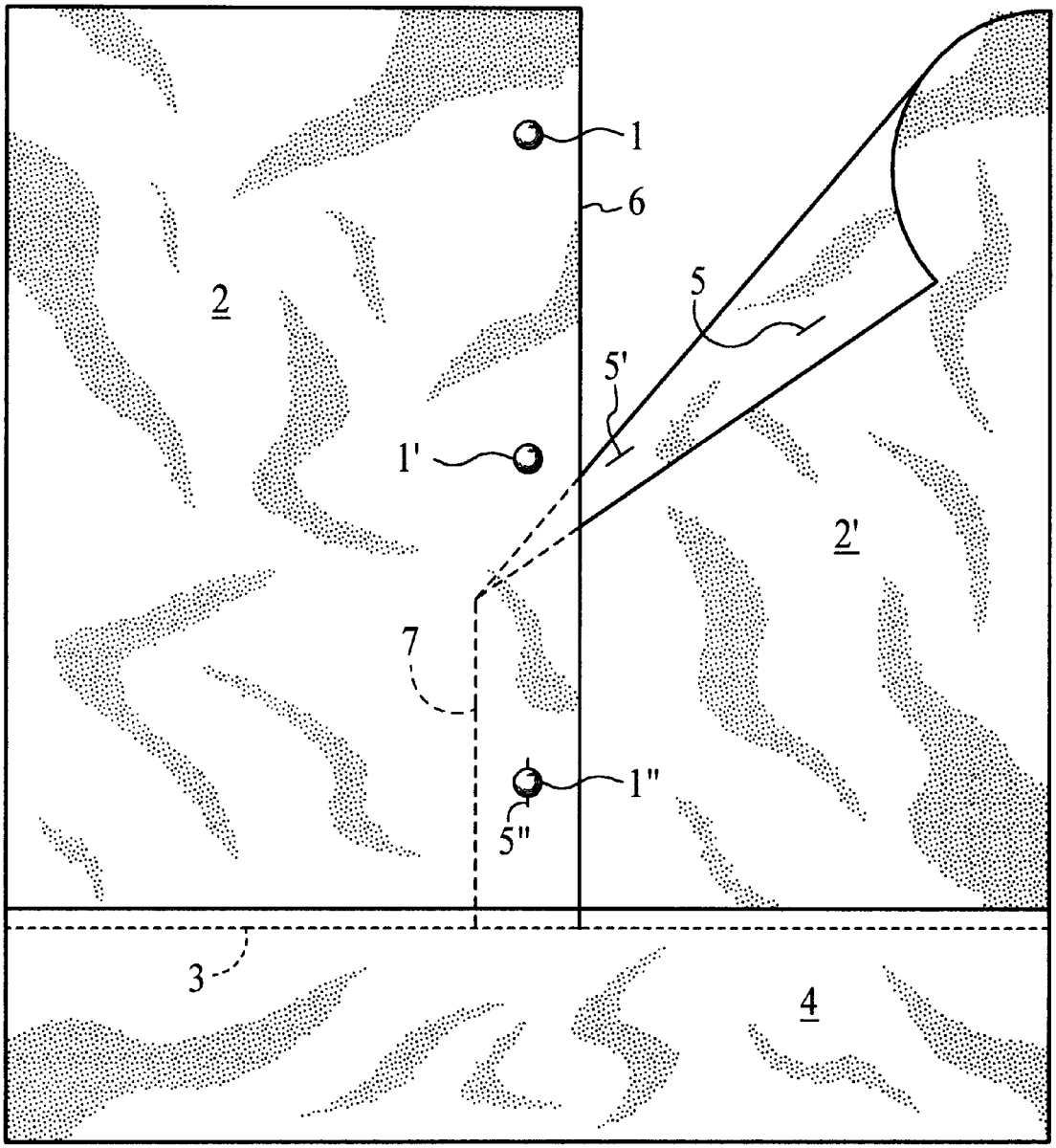
FIG. 2 is the preferred embodiment of the present invention as shown in FIG. 1 which illustrates the blanket laying flat with the longitudinal sections partially unfastened and the right section moving to a position at the base of the blanket.

An additional embodiment is illustrated in FIG. 2 showing the blanket with the left longitudinal section 2 laying flat & fully extended and the right longitudinal section 2' partially unfastened and moving to a position at the base of the blanket. Both longitudinal sections 2 & 2' are permanently attached by a seam 3 to the transverse base section 4 that runs the width of the cover. The left longitudinal section 2 is shown, in this case, with two buttons unfastened 1 & 1' and one button 1" fastened. The right longitudinal section 2' shown, in this case, with two button holes unfastened 5 & 5' and one button hole fastened 5".

What is claimed is:

1. In an improved split-able bed covering, a pair of longitudinally extending rectangular fabric sections each having a pair of opposed long edges, a short upper edge, and an opposed short lower edge wherein said longitudinally extending sections are placed side by side overlapping each other along an entire respective long edge of each said longitudinally extending section such that said short upper edges are aligned and said short lower edges are aligned and secured in a permanent manner to a transversely extending rectangular fabric base section having a pair of opposed long sides wherein each said long side has a length which is equal to the combined respective widths of said longitudinally extending sections when overlapping each other, said longitudinally extending sections being attached to said transversely extending base section entirely along said short lower edges to an opposed long side of said transversely extending base section, said longitudinally extending sections are selectively attached to each other along said overlapping long edges by use of one or more buttons or other suitable fastening device.

2. An improved bed covering as defined in claim one, wherein the pair of longitudinally extending sections will overlap one or more inches to provide ample personal coverage when only one section is extended and the other section rolled down and not being used as a cover.

3. An improved bed covering as defined in claims one or two, wherein said pair of longitudinally extending fabric sections and the transversely extending fabric base section are permanently secured together by a seam running transverse to the opposed long edges of said longitudinally extending sections and parallel to the opposed long edges of said transversely extending base section to provide a single unit bed cover with a pair split-able upper sections.

* * * * *